US012031101B2

(12) United States Patent
Stidder et al.

(10) Patent No.: US 12,031,101 B2
(45) Date of Patent: Jul. 9, 2024

(54) RELATING TO LUBRICATING COMPOSITIONS

(71) Applicant: Infineum International Limited, Abingdon (GB)

(72) Inventors: Gregory Stidder, Wantage (GB); Robert W. Shaw, Abingdon (GB); Simon Crick, Wallingford (GB)

(73) Assignee: Infineum International Limited, Abingdon (GB)

( * ) Notice: Subject to any disclaimer, the term of this patent is extended or adjusted under 35 U.S.C. 154(b) by 0 days.

(21) Appl. No.: 15/900,842

(22) Filed: Feb. 21, 2018

(65) Prior Publication Data

US 2018/0237718 A1 Aug. 23, 2018

(30) Foreign Application Priority Data

Feb. 22, 2017 (EP) ..... 17157432

(51) Int. Cl.
*C10M 169/00* (2006.01)
*C10M 101/00* (2006.01)
(Continued)

(52) U.S. Cl.
CPC ..... *C10M 141/12* (2013.01); *C10M 101/00* (2013.01); *C10M 129/54* (2013.01);
(Continued)

(58) Field of Classification Search
CPC ..... C10M 141/12; C10M 169/044; C10M 155/02; C10M 139/04; C10M 129/54;
(Continued)

(56) References Cited

U.S. PATENT DOCUMENTS 3,088,814 A 5/1963 Gorsich
4,282,107 A 8/1981 Zoleski et al.
(Continued)

FOREIGN PATENT DOCUMENTS

JP 08337788 A * 12/1996
JP 08337788 A 12/1996
(Continued)

OTHER PUBLICATIONS

"Lubricant Additives: Chemistry And Applications", Edited by Leslie R. Rudnick, CRC Press, Boca Raton, FL., 2003, p. 427.
(Continued)

*Primary Examiner* — Taiwo Oladapo
(74) *Attorney, Agent, or Firm* — Robert A. Migliorini

(57) ABSTRACT

A lubricating oil composition, a method of reducing low-speed pre-ignition (LSPI) in a direct-injected spark-ignited internal combustion engine, and a use of a lubricant composition to reduce LSPI events in such an engine. Preferably, the composition comprises a detergent comprising an over-based calcium detergent having a total base number (TBN) of at least 150, wherein the lubricating oil composition has a calcium content of at least 0.08 wt. %, based on the weight of the lubricating oil composition, and wherein the lubricating oil composition has a silicon content of at least 12 ppm by weight, based on the weight of the lubricating oil composition.

45 Claims, 1 Drawing Sheet

(51) Int. Cl.

| | |
|---|---|
| ***C10M 129/54*** | (2006.01) |
| ***C10M 139/04*** | (2006.01) |
| ***C10M 141/12*** | (2006.01) |
| ***C10M 155/02*** | (2006.01) |
| ***C10M 169/04*** | (2006.01) |
| *C10N 30/04* | (2006.01) |
| *C10N 40/25* | (2006.01) |

(52) U.S. Cl.
CPC ..... *C10M 139/04* (2013.01); *C10M 155/02* (2013.01); *C10M 169/044* (2013.01); *C10M 2203/003* (2013.01); *C10M 2207/129* (2013.01); *C10M 2207/144* (2013.01); *C10M 2215/064* (2013.01); *C10M 2215/28* (2013.01); *C10M 2227/02* (2013.01); *C10M 2227/04* (2013.01); *C10M 2229/041* (2013.01); *C10M 2229/042* (2013.01); *C10M 2229/046* (2013.01); *C10M 2229/047* (2013.01); *C10M 2229/052* (2013.01); *C10N 2030/04* (2013.01); *C10N 2040/255* (2020.05)

(58) Field of Classification Search
CPC ..... C10M 101/00; C10M 2207/129; C10M 2215/064; C10M 2215/28; C10M 2227/02; C10M 2229/041; C10M 2229/042; C10M 2229/052; C10M 2229/047; C10M 2207/144; C10M 2203/003; C10M 2229/046; C10M 2227/04; C10N 2240/104; C10N 2230/04
See application file for complete search history.

(56) References Cited

U.S. PATENT DOCUMENTS

| | | | | |
|---|---|---|---|---|
| 5,919,883 | A * | 7/1999 | Dittrich | B01F 17/0071 528/15 |
| 10,214,730 | B2 | 2/2019 | Fletcher et al. | |
| 10,604,720 | B2 | 3/2020 | Gao et al. | |
| 11,034,912 | B2 | 6/2021 | Ritchie et al. | |
| 11,142,719 | B2 | 10/2021 | Cant et al. | |
| 11,214,756 | B2 | 1/2022 | Mosier et al. | |
| 11,584,897 | B2 | 2/2023 | Gupta et al. | |
| 2004/0235686 | A1 | 11/2004 | Boons et al. | |
| 2006/0019839 | A1 | 1/2006 | Murray | |
| 2006/0052253 | A1 | 3/2006 | Murray | |
| 2007/0244016 | A1 | 10/2007 | Buck | |
| 2008/0058232 | A1 | 3/2008 | Yamaguchi et al. | |
| 2015/0232782 | A1 * | 8/2015 | Fisher | C10M 169/042 508/208 |
| 2015/0322367 | A1 | 11/2015 | Patel et al. | |
| 2016/0130514 | A1 | 5/2016 | Hansch | |
| 2016/0230115 | A1 * | 8/2016 | Mosier | C10M 169/04 |
| 2018/0237718 | A1 | 8/2018 | Stidder et al. | |
| 2019/0360383 | A1 | 11/2019 | Miller | |
| 2020/0255762 | A1 | 8/2020 | Elliott et al. | |

FOREIGN PATENT DOCUMENTS

| | | | | |
|---|---|---|---|---|
| WO | WO-2004005439 | A2 * | 1/2004 | C10L 1/14 |
| WO | WO-2012/106170 | A1 | 8/2012 | |
| WO | 2017011633 | A1 | 1/2017 | |
| WO | WO-2017/011833 | A1 | 1/2017 | |
| WO | 2020-064719 | A1 | 4/2020 | |

OTHER PUBLICATIONS

"High TBN 300 Calcium Alkyl Salicylate," as retrieved from: https://sinoruifeng.en.alibaba.com/product/60749826694-219241018/High_TBN_300_Calcium_Alkyl_Salicylate.html on Feb. 12, 2019, 7 pages.

Flick, E. W. "Industrial Surfactants." 2nd Edition, Park Ridge, N.J: Noyes Publications, 1993, p. 207.

Kosuke Fujimoto et al., Engine Oil Development for Preventing Pre-Ignition in Turbocharged Gasoline Engine , SAE Intemation Journal of Fuels and Lubricants, vol. 7, No. 3, Apr. 15, 2014, pp. 869-874 (XP055248491).

Functional Silicones and Silicone-Containing Block Copolymers; Dissertation by Paul Bohm; pp. 1-139.

Third Party Observations from European Application 18156541.7 dated Apr. 28, 2022—Part 1 of 2.

CONT. Third Party Observations from European Application 18156541.7 dated Apr. 28, 2022—Part 2 of 2.

Chapman, E., et al., "A Literature Review of Abnormal Ignition by Fuel and Lubricant Derivatives", SAE Int. J. Engines vol. 9, Issue 1 (Apr. 2016), pp. 107-142.

Lubricant Additives : Use and Benefits, Aug. 2016, ATC Document 118.

Lubricant Additives and The Environment, Dec. 2007, ATC Document 49, Rev. 1.

* cited by examiner

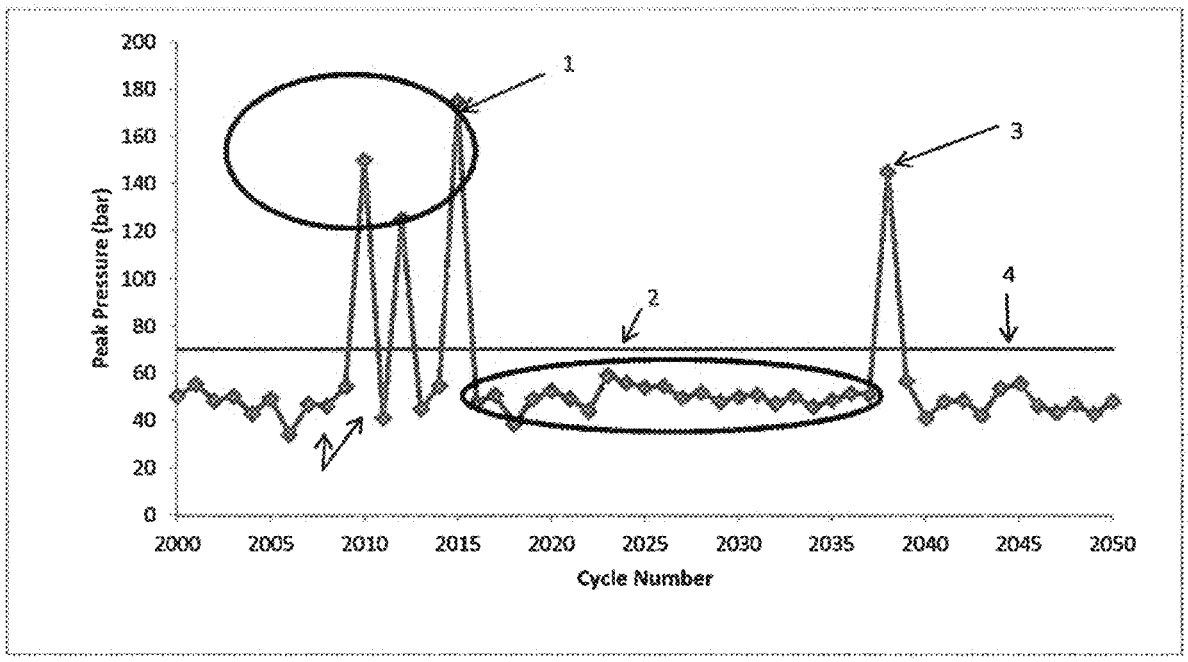
200
180
160
140
120
100
80
60
40
20
0
Peak Pressure (bar)
2000
2005
2010
2015
2020
2025
2030
2035
2040
2045
2050
Cycle Number
1
2
3
4

RELATING TO LUBRICATING COMPOSITIONS

FIELD OF THE INVENTION

The present invention concerns lubricating compositions. More particularly, but not exclusively, this invention concerns lubricating compositions for reducing the occurrence of Low Speed Pre-Ignition (or low speed pre-ignition events) in spark-ignited internal combustion engines, in which a lubricating oil composition having a defined silicon content is used to lubricate the engine crankcase.

BACKGROUND OF THE INVENTION

Market demand, as well as governmental legislation, has led automotive manufacturers to continuously improve fuel economy and reduce $CO_2$ emissions across engine families, while simultaneously maintaining performance (horsepower). Using smaller engines providing higher power densities, increasing boost pressure, by using turbochargers or superchargers to increase specific output, and downspeeding the engine by using higher transmission gear ratios allowed by higher torque generation at lower engine speeds, has allowed engine manufacturers to provide excellent performance while reducing frictional and pumping losses. However, higher torque at lower engine speeds has been found to cause random pre-ignition in engines at low speeds, a phenomenon known as Low Speed Pre-Ignition, or LSPI, resulting in extremely high cylinder peak pressures, which can lead to catastrophic engine failure. The possibility of LSPI prevents engine manufacturers from fully optimizing engine torque at lower engine speed in such smaller, high-output engines.

While not wishing to be bound by any specific theory, it is believed that LSPI may be caused, at least in part, by auto-ignition of droplets (comprising engine oil, or a mixture of engine oil, fuel and/or deposits) that enter the engine combustion chamber from the piston crevice (space between the piston ring pack and cylinder liner) under high pressure, during periods in which the engine is operating at low speeds, and compression stroke time is longest (e.g., an engine having a 7.5 msec compression stroke at 4000 rpm may have a 24 msec compression stroke when operating at 1250 rpm). Therefore, it would be advantageous to identify and provide lubricating oil compositions that are resistant to auto-ignition and therefore prevent or ameliorate the occurrence of LSPI.

Some attempts have been made in the art to address this problem. For example, SAE 2013-01-2569 ("Investigation of Engine Oil Effect on Abnormal Combustion in Turbocharged Direct Injection-Spark Ignition Engines (Part 2)", Hirano et al.) concludes that increasing calcium concentration leads to greater LSPI frequency. It is also concluded that increasing zinc dihydrocarbyl dithiophosphate (ZDDP) concentration can reduce LSPI frequency. SAE 2014-01-2785 ("Engine Oil Development for Preventing Pre-Ignition in Turbocharged Gasoline Engine", Fujimoto et al.) concludes that reducing the amount of calcium detergent in a lubricating oil formulation is the most effective approach at reducing LSPI events. It is also concluded that increasing the amount of ZDDP can be effective in reducing LSPI frequency. SAE 2015-01-2027 ("Engine Oil Formulation Technology to Prevent Pre-Ignition in Turbocharged Direct Injection Spark Ignition Engines", Onodera et al.) concludes that (a) reducing calcium content together with increasing molybdenum content in engine oil formulations, and (b) substitution of calcium with magnesium in detergents for engine oil formulations, were both effective in reducing the frequency of LSPI events.

The prior art has recognised that reducing the calcium content, and/or increasing the ZDDP content, of a lubricating oil formulation can lead to a reduction in LSPI events. However, detergents are often considered to be necessary additives for maintaining basic engine oils performance. Thus, recent efforts in providing lubricating oil formulations that reduce LSPI events have focused on replacing calcium detergents with alternative detergents. However, alternative detergents capable of providing appropriate detergent activity and adequate total base number (TBN) can be challenging to develop. Furthermore, increased ZDDP content in lubricating oil formulations can lead to other, less desirable, effects. In particular, increasing ZDDP concentration often leads to an increase in ash formation and can lead to damage of catalysts in engine exhaust systems.

Thus, there remains a need for a lubricating oil composition suitable for use in modern direct injection-spark ignition engines that reduces occurrences of LSPI events.

SUMMARY OF THE INVENTION

The present inventors have surprisingly found that the presence of silicon in a lubricating oil composition in amounts of at least 12 ppm by weight, based on the weight of the lubricating oil composition, significantly reduces in the frequency of LSPI events in direct injection-spark ignition internal combustion engines when the crankcase of the engine is lubricated with said lubricating oil composition, for example as compared to when the crankcase is lubricated with a composition comprising less than 12 ppm by weight silicon.

Thus, the present invention provides, according to a first aspect, A lubricating oil composition comprising a base oil of lubricating viscosity, a calcium containing detergent, and a silicon containing additive, wherein calcium containing detergent provides the lubricating oil composition with a calcium content of at least 0.08 wt. %, based on the weight of the lubricating oil composition, and wherein the silicon containing additive provides the lubricating oil composition with a silicon content of at least 12 ppm by weight, based on the weight of the lubricating oil composition.

According to a second aspect, the present invention provides a method of reducing the occurrence of LSPI events in a direct injection-spark ignition internal combustion engine comprising lubricating the crankcase of the engine with a lubricating oil composition, the composition having a silicon content of at least 12 ppm by weight, based on the weight of the lubricating oil composition. Optionally, the lubricating oil composition is the lubricating oil composition of the first aspect of the invention.

According to a third aspect, the present invention provides a use of a silicon-containing additive in a lubricating oil composition to reduce occurrence of LSPI events in a direct injection-spark ignition internal combustion engine. Optionally, the lubricating oil composition is the lubricating oil composition of the first aspect of the invention.

In this specification, the following words and expressions, if and when used, have the meanings ascribed below:

"hydrocarbyl" means a chemical group of a compound that normally contains only hydrogen and carbon atoms and that is bonded to the remainder of the compound directly via a carbon atom;

"oil-soluble" or "oil-dispersible", or cognate terms, do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil in employed. Moreover, the additional incorporation of other additives may also permit incorporation of higher levels of a particular additive, if desired;

"major amount" mean in excess of 50 mass % of a composition;

"minor amount" means 50 mass % or less of a composition;

"antifoam" is a chemical additive that reduces and hinders the formation of foam in the lubricating oil composition;

"TBN" means total base number as measured by ASTM D2896 in units of mg $KOHg^{-1}$;

"phosphorus content" is measured by ASTM D5185;

"sulfur content" is measured by ASTM D2622; and,

"sulphated ash content" is measured by ASTM D874.

Also, it will be understood that various components used, essential as well as optional and customary, may react under conditions of formulation, storage or use and that the invention also provides the product obtainable or obtained as a result of any such reaction. Further, it is understood that any upper and lower quantity, range and ratio limits set forth herein may be independently combined. Furthermore, the constituents of this invention may be isolated or be present within a mixture and remain within the scope of the invention.

It will of course be appreciated that features described in relation to one aspect of the present invention may be incorporated into other aspects of the present invention. For example, the method of the invention may incorporate any of the features described with reference to the composition of the invention and vice versa.

BRIEF DESCRIPTION OF THE FIGURES

FIG. 1 shows graphically the occurrence of LSPI events in an engine, in accordance with the method of determining the occurrence of LSPI events as used in the Examples of the present specification.

DETAILED DESCRIPTION

Several terms exist for various forms of abnormal combustion in spark ignited internal combustion engines including knock, extreme knock (sometimes referred to as super-knock or mega-knock), surface ignition, and pre-ignition (ignition occurring prior to spark ignition). Extreme knock occurs in the same manner as traditional knock, but with increased knock amplitude, and can be mitigated using traditional knock control methods. LSPI usually occurs at low speeds and high loads. In LSPI, initial combustion is relatively slow and similar to normal combustion, followed by a sudden increase in combustion speed. LSPI is not a runaway phenomenon, unlike some other types of abnormal combustion. Occurrences of LSPI are difficult to predict, but are often cyclical in nature.

LSPI is most likely to occur in direct-injected, boosted (turbocharged or supercharged), spark-ignited (gasoline) internal combustion engines that, in operation, generate a brake mean effective pressure level of greater than about 1,500 kPa (15 bar) (peak torque), such as at least about 1,800 kPa (18 bar), particularly at least about 2,000 kPa (20 bar) at engine speeds of from about 1000 to about 2500 rotations per minute (rpm), such as at engine speeds of from about 1000 to about 2000 rpm. As used herein, brake mean effective pressure (BMEP) is defined as the work accomplished during an engine cycle, divided by the engine sweep volume; the engine torque normalized by engine displacement. The word "brake" denotes the actual torque or power available at the engine flywheel, as measured on a dynamometer. Thus, BMEP is a measure of the useful power output of the engine.

SAE 2014-01-2785 has concluded that LSPI event frequency is strongly influenced by the calcium content of the lubricating oil composition, and that it is preferable to avoid lubricating composition calcium contents of greater than 0.11 wt. %, based on the weight of the lubricating oil composition, in order to avoid excessive LSPI event frequency.

Surprisingly, the present inventors have found that the presence of silicon in a lubricating oil formulation is effective at reducing the occurrence of LSPI events. More particularly, the present inventors have found that the presence of at least 12 ppm by weight silicon, based on the weight of the lubricating oil composition, is effective at effectively reducing LSPI event frequency even when the lubricating oil composition comprises calcium in an amount of at least 0.08 wt. %, based on the weight of the lubricating oil composition. In other words, the present inventors have found that, for a lubricating oil composition having a calcium content of at least 0.08 wt. %, based on the weight of the lubricating oil composition, a formulation comprising at least 12 ppm by weight silicon, based on the weight of the lubricating oil composition, shows a lower tendency for LSPI events than a lubricating oil composition with less than 12 ppm by weight silicon. It has now been found that the occurrence of LSPI in engines can be reduced by lubricating the crankcase with lubricating oil compositions comprising at least 12 ppm by weight silicon, based on the weight of the lubricating oil composition, for example a lubricating oil composition comprising at least 0.08 wt. % calcium and at least 12 ppm by weight silicon, based on the weight of the lubricating oil composition. Without wishing to be bound be theory, the present inventors believe that the silicon in the lubricating oil composition reduces the susceptibility of the composition to combustion, thus reducing LSPI event frequency.

Optionally, the lubricating oil composition comprises at least 15 ppm silicon, preferably at least 18 ppm silicon, such as greater than 20 ppm silicon, by weight, based on the weight of the lubricating oil composition. Optionally, the lubricating oil composition comprises no more than 2000 ppm silicon, such as no more than 1750 ppm silicon, for example no more than 1500 ppm silicon, by weight, based on the weight of the lubricating oil composition. Optionally, the lubricating oil composition comprises from 12 ppm to 2000 ppm silicon, preferably from 15 to 2000 ppm silicon, such as from 15 to 1750 ppm silicon, for example from greater than 20 to 2000 ppm silicon, by weight, based on the weight of the lubricating oil composition. It may be that higher silicon contents provide further improvements in LSPI frequency reduction. It may also be that there is a balance between increasing silicon content to reduce LSPI and achieving adequate solubility of silicon-containing compounds in the lubricating oil composition to meet product quality requirements. For example, it may be that excessive quantities of silicon-containing compounds gives a cloudy appearance to the lubricating oil composition.

Optionally, the lubricating oil composition comprises a silicon antifoam additive. Preferably, at least a portion of the silicon content of the lubricating oil composition is provided by a silicon antifoam additive, such as a major portion. It may be that introducing at least a portion of the silicon content of the lubricating oil composition into the composition in the form of a silicon-containing antifoam additive provides a particularly convenient way of introducing silicon. Optionally, one or more silicon antifoam agents provide at least 3 ppm, such as at least 4 ppm, for example at least 5 ppm, by weight silicon in the lubricating oil composition, based on the weight of the lubricating oil composition. Optionally, at least 20 wt. %, preferably at least 40 wt. %, such as at least 60 wt. %, for example at least 80 wt. %, of the silicon in the lubricating oil composition, based on the weight of the silicon in the lubricating oil composition, is provided by one or more silicon antifoam additives. Optionally, 100 wt %, of the silicon in the lubricating oil composition, based on the weight of the silicon in the lubricating oil composition, is provided by one or more silicon antifoam additives. Optionally, from 20 wt. % to 100 wt. %, preferably from 40 wt. % to 80 wt. %, such as from 50 wt. % to 70 wt %, of the silicon in the lubricating oil composition, based on the weight of the silicon in the lubricating oil composition, is provided by one or more silicon antifoam additives. Additionally, or alternatively, the lubricating oil composition optionally comprises an antifoam additive that is free from silicon (in other words, the lubricating oil composition optionally comprises a non-silicon antifoam additive).

Optionally, the lubricating oil composition comprises one or more silicon-containing compounds that is not an antifoam agent (for example, that is not used as an antifoam agent). In a preferred embodiment, at least a portion of the silicon content of the lubricating oil composition is provided by a silicon-containing compound that is not an antifoam, such as a major portion. It may be that introducing at least a portion of the silicon content of the lubricating oil composition into the composition in the form of a silicon-containing compound that is not an antifoam provides a particularly convenient way of introducing silicon, for example it may be that at least some silicon-containing compounds that are not antifoam additives are more soluble in oil compositions than silicon antifoam additives. Optionally, one or more silicon-containing compounds that are not antifoam additives provide at least 9 ppm, such as at least 12 ppm, for example at least 15 ppm, by weight silicon in the lubricating oil composition, based on the weight of the lubricating oil composition. Optionally, at least 20 wt. %, preferably at least 40 wt. %, such as at least 60 wt. %, for example at least 80 wt. %, of the silicon in the lubricating oil composition, based on the weight of the silicon in the lubricating oil composition, is provided by one or more silicon-containing compounds that are not antifoam additives. Optionally, 100 wt. %, of the silicon in the lubricating oil composition, based on the weight of the silicon in the lubricating oil composition, is provided by one or more silicon-containing compounds that are not antifoam additives. Optionally, from 20 wt. % to 100 wt. %, preferably from 40 wt. % to 80 wt. %, such as from 50 wt. % to 70 wt. %, of the silicon in the lubricating oil composition, based on the weight of the silicon in the lubricating oil composition, is provided by one or more silicon-containing compounds that are not antifoam additives.

Optionally, the lubricating oil composition comprises one or more siloxane compound, such as a polymeric siloxane compound. Preferably, the lubricating oil composition comprises one or more siloxane compound in an amount of at least about 0.01 wt. %, such as at least about 0.015 wt. %, for example at least about 0.02 wt. %, based on the weight of the lubricating oil composition. Optionally, the lubricating oil composition comprises one or more siloxane compound in an amount of about 0.01 wt. % to about 0.1 wt. %, such as about 0.015 wt. % to about 0.07 wt. %, for example about 0.02 wt. % to about 0.04 wt. %, based on the weight of the lubricating oil composition. For example, it may be that the lubricating oil composition comprises a polyalkyl siloxane, such as a polydialkyl siloxane, for example wherein alkyl is a $C_1$-$C_{10}$ alkyl group, e.g. a polydimethylsiloxane (PDMS), also known as a silicone oil. It may be that, for example, the lubricating oil composition comprises a polymeric siloxane compound according to Formula 1, below, wherein $R^1$ and $R^2$ are methyl, and n is from 50 to 450. Optionally, a major portion of the silicon content of the lubricating oil is provided by the one or more siloxane compound.

Additionally, or alternatively, it may be that the lubricating oil composition comprises an organo modified siloxane (OMS), such as a siloxane modified with an organo group such as a polyether (e.g. ethylene-propyleneoxide copolymer), long chain hydrocarbyl (e.g. $C_{11}$-$C_{100}$ alkyl), or aryl (e.g. $C_6$-$C_{14}$ aryl). Preferably, the lubricating oil composition comprises one or more OMS compounds in an amount of at least about 0.01 wt. %, such as at least about 0.05 wt. %, for example at least about 0.1 wt. %, based on the weight of the lubricating oil composition. Optionally, the lubricating oil composition comprises one or more OMS compounds in an amount of about 0.01 wt. % to about 0.6 wt. %, such as about 0.05 wt. % to about 0.4 wt. %, for example about 0.1 wt. % to about 0.2 wt. %, based on the weight of the lubricating oil composition. It may be that, for example, the lubricating oil composition comprises an organo modified siloxane compound according to Formula 1, wherein n is from 50 to 450, and wherein $R^1$ and $R^2$ are the same or different, optionally wherein each of $R^1$ and $R^2$ is, independently an organo group, such as an organo group as defined hereinabove. Preferably, one of $R^1$ and $R^2$ is $CH_3$. Optionally, a major portion of the silicon content of the lubricating oil is provided by the one or more OMS compounds. It may be that, for example, OMS compounds are particularly soluble in lubricating oil compositions, thus providing a particularly convenient additive for providing a relatively high silicon content in a lubricating oil composition.

Formula 1

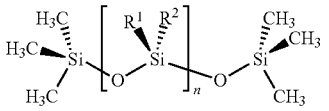

Optionally, the lubricating oil composition comprises one or more small molecule silicon compound, for example an organic small molecule silicon compound. Preferably, the lubricating oil composition comprises one or more small molecule silicon compounds in an amount of at least about 0.01 wt. %, such as at least about 0.03 wt. %, for example at least about 0.06 wt. %, based on the weight of the lubricating oil composition. Optionally, the lubricating oil composition comprises one or more small molecule silicon compounds in an amount of about 0.01 wt. % to about 0.3 wt. %, such as about 0.03 wt. % to about 0.2 wt. %, for example about 0.06 wt. % to about 0.1 wt. %, based on the weight of the lubricating oil composition.

Preferably, a small molecule silicon compound is a silicon-containing molecule having a molecular weight of no more than 600 g/mol, such as no more than 450 g/mol, for example, no more than 300 g/mol. Optionally, a small molecule silicon compound is a silicon-containing molecule having a molecular weight of from 78 to 600 g/mol, such as from 100 to 450 g/mol, for example from 130 to 300 g/mol. Additionally, or alternatively, a small molecule silicon compound is a silicon compound having a carbon number of from 4 to 24, such as from 4 to 20, for example from 8 to 13, and/or a silicon number of from 1 to 8, such as from 1 to 4, for example from 1 to 2. It will be appreciated that a molecule having a carbon number of 4, for example, is a molecule comprising 4 carbon atoms.

Preferably, a major portion of the silicon content of the lubricating oil is provided by the one or more small molecule silicon compounds. It may be that, for example, small molecule silicon compounds are particularly soluble in lubricating oil compositions and provide a particularly even and effective dispersion of silicon in the composition.

Optionally, the lubricating oil composition comprises one or more small molecule silicon compounds according to Formula 2, wherein each of $R^1$, $R^2$, $R^3$ and $R^4$ is, independently, a $C_1$-$C_{10}$ hydrocarbyl group or a $C_1$-$C_{10}$ heterocarbyl group, such as a $C_1$-$C_{10}$ alkyl group or a $C_1$-$C_{10}$ aklyoxy group. Optionally, at least one of, such as at least two or, for example at least three of, optionally all of the $R^1$, $R^2$, $R^3$ and $R^4$ groups is selected from the list consisting of methyl, ethyl, propyl, butyl, pentyl, hexyl, heptyl, octyl, nonyl, and decyl groups, such as ethyl, propyl, and butyl groups. Additionally, or alternatively, at least one of, such as at least two or, for example at least three of, optionally all of the $R^1$, $R^2$, $R^3$ and $R^4$ groups is selected from the list consisting of methyloxy, ethyloxy, propyloxy, butyloxy, pentyloxy, hexyloxy, heptyloxy, octyloxy, nonyloxy, and decyloxy groups, such as ethyloxy, propyloxy, and butyloxy groups. Optionally, at least one of the $R^1$, $R^2$, $R^3$ and $R^4$ groups is an alkyl group and at least one of the $R^1$, $R^2$, $R^3$ and $R^4$ groups is an alkoxy group.

In a preferred embodiment, the lubricating oil composition comprises one or more silicon-containing compounds selected from the list consisting of tetraethylsilane ($Si(C_2H_5)_4$), tetraethyl orthosilicate ($Si(OC_2H_5)_4$), triethoxymethylsilane ($CH_3Si(OC_2H_5)_3$) and tetrabutyl orthosilicate ($Si(OC_4H_9)_4$). In an embodiment of the invention, the lubricating oil composition the one or more silicon-containing compounds is selected from the list consisting of tetraethylsilane ($Si(C_2H_5)_4$), tetraethyl orthosilicate ($Si(OC_2H_5)_4$), triethoxymethylsilane ($CH_3Si(OC_2H_5)_3$) and tetrabutyl orthosilicate ($Si(OC_4H_9)_4$).

Formula 2

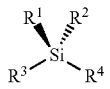

Optionally, the lubricating oil composition comprises one or more silazane compounds. Preferably, the lubricating oil composition comprises one or more silazane compounds in an amount of at least about 0.01 wt. %, such as at least about 0.03 wt. %, for example at least about 0.06 wt. %, based on the weight of the lubricating oil composition. Optionally, the lubricating oil composition comprises one or more silazane compounds in an amount of about 0.01 wt. % to about 0.3 wt. %, such as about 0.03 wt. % to about 0.2 wt. %, for example about 0.06 wt. % to about 0.1 wt. %, based on the weight of the lubricating oil composition. For example, it may be that the silazane compound is a compound according to Formula 3, below, wherein each of $R^1$ and $R^2$ is, independently, a $C_1$-$C_3$ hydrocarbyl group, such as a $C_1$-$C_3$ alkyl group. Optionally, at least one of, such both of the $R^1$ and $R^2$ groups is selected from the list consisting of methyl, ethyl, and propyl. Optionally, the lubricating oil composition comprises octamethyl cyclotetrasilazane $C_8H_{25}N_4Si_4$.

Formula 3

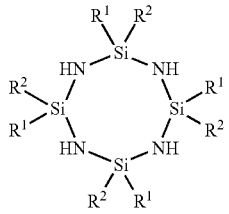

In an embodiment of the present invention that silicon-containing compound is does not comprise a fluorinated polysiloxane.

Preferably, the composition comprises one or more silicon-containing compounds selected from the list consisting of siloxane compounds, organo modified siloxane compounds, small molecule silicon compounds, and silazane compounds. In an embodiment, the composition comprises one or more silicon-containing compounds selected from the list consisting of siloxane compounds, organo-modified siloxane compounds, tetraethylsilane ($Si(C_2H_5)_4$), tetraethyl orthosilicate ($Si(OC_2H_5)_4$), triethoxymethylsilane ($CH_3Si(OC_2H_5)_3$), tetrabutyl orthosilicate ($Si(OC_4H_9)_4$) and silazane compounds.

Preferably, the lubricating oil composition comprises said silicon-containing compound in an amount of at least about 0.01 wt. %, such as at least about 0.015 wt. %, for example at least about 0.02 wt. %, based on the weight of the lubricating oil composition. Preferably, the lubricating oil composition comprises said silicon-containing compound in an amount of no more than 0.5 wt. %, such as no more than 0.4 wt. %, for example no more than 0.3 wt. %, based on the weight of the lubricating oil composition. Optionally, the lubricating oil composition comprises said silicon-containing compound in an amount of about 0.01 wt % to about 0.5 wt. %, such as about 0.015 wt. % to about 0.4 wt. %, for example about 0.015 wt % to about 0.3 wt. %, based on the weight of the lubricating oil composition.

Suitably, the silicon content of the lubricating oil described herein above is provided entirely by the silicon compounds as described hereinabove.

A lubricating oil composition according to the present invention has a calcium content of at least 0.08 wt. %. Optionally, the lubricating oil composition has a calcium content of at least 0.10 wt. %, preferably at least 0.12 wt %, for example at least 0.14 wt. %, based on the weight of the lubricating oil composition. Optionally, the lubricating oil composition has a calcium content of from 0.08 wt % to 0.40 wt. %, preferably from 0.10 wt. % to 0.3 wt. %, for example from 0.12 wt. % to 0.25 wt. %, such as from 0.14 w.t % to 0.20 wt. %, based on the weight of the lubricating oil composition.

Suitably, the calcium content of the lubricating oil composition of the present invention is provided by a metal-containing detergent. Metal-containing or ash-forming detergents function as both detergents to reduce or remove deposits and as acid neutralizers or rust inhibitors, thereby reducing wear and corrosion and extending engine life.

Detergents generally comprise a polar head with a long hydrophobic tail. The polar head comprises a metal salt of an acidic organic compound. The salts may contain a substantially stoichiometric amount of the metal in which case they are usually described as normal or neutral salts, and have a total base number or TBN (as can be measured by ASTM D2896) of from 0 to less than 150, such as 0 to about 80 or 100. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g. carbonate) micelle. Such overbased detergents have a TBN of 150 or greater, and typically will have a TBN of from 250 to 450 or more.

Detergents that may be used in all aspects of the present invention include, oil-soluble neutral and overbased metal salts of sulfonates, phenates, sulfurized phenates, thiophosphonates, salicylates, and naphthenates and other oil-soluble carboxylates. Suitable metals for the detergents include alkali or alkaline earth metals, e.g., barium, sodium, potassium, lithium, calcium, and/or magnesium. The most commonly used additional metals are calcium, magnesium and sodium.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples include those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 mass % (preferably at least 125 mass %) of that stoichiometrically required.

Phenate detergents are metal salts of phenols and sulfurized phenols, prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges. For the purpose of this invention phenate detergents do not include phenolate detergents.

Carboxylate detergents, e.g., salicylates, can be prepared by reacting an aromatic carboxylic acid with an appropriate metal compound such as an oxide or hydroxide and neutral or overbased products may be obtained by methods well known in the art. The aromatic moiety of the aromatic carboxylic acid can contain hetero-atoms, such as nitrogen and oxygen. Preferably, the moiety contains only carbon atoms; more preferably the moiety contains six or more carbon atoms; for example, benzene is a preferred moiety. The aromatic carboxylic acid may contain one or more aromatic moieties, such as one or more benzene rings, either fused or connected via alkylene bridges. The carboxylic moiety may be attached directly or indirectly to the aromatic moiety. Preferably the carboxylic acid group is attached directly to a carbon atom on the aromatic moiety, such as a carbon atom on the benzene ring. More preferably, the aromatic moiety also contains a second functional group, such as a hydroxy group or a sulfonate group, which can be attached directly or indirectly to a carbon atom on the aromatic moiety.

Preferred examples of aromatic carboxylic acids are salicylic acids and sulfurized derivatives thereof, such as hydrocarbyl substituted salicylic acid and derivatives thereof. Processes for sulfurizing, for example a hydrocarbyl-substituted salicylic acid, are known to those skilled in the art. Salicylic acids are typically prepared by carboxylation, for example, by the Kolbe-Schmitt process, of phenoxides, and in that case, will generally be obtained, normally in a diluent, in admixture with uncarboxylated phenol.

Preferred substituents in oil-soluble salicylic acids are alkyl substituents. In alkyl-substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil solubility.

Detergents generally useful in the formulation of lubricating oil compositions of the invention also include "hybrid" detergents formed with mixed surfactant systems, e.g., phenate/salicylates, sulfonate/phenates, sulfonate/salicylates, sulfonates/phenates/salicylates, as described, for example, in U.S. Pat. Nos. 6,153,565; 6,281,179; 6,429,178; and 6,429,178.

Suitably, the detergent comprises a phenate detergent, a sulfonate detergent, a salicylate detergent or any mixture thereof.

In one embodiment of the present invention, the detergent comprises an overbased calcium detergent, having a TBN of at least 150 mg KOH/g, preferably at least 200 mg KOH/g. Preferably, the overbased calcium detergent has a TBN of from 200 to 450. The detergent is preferably used in an amount providing the lubricating oil composition with a TBN of from about 4 to about 10 mg KOH/g, preferably from about 5 to about 8 mg KOH/g.

In one embodiment of the present invention the calcium content is provided by a plurality of different calcium detergents. The calcium content may be provided by a neutral or overbased calcium phenate, calcium salicylate, calcium sulfonate of any mixture thereof. In another embodiment, the calcium content is provided by a plurality of detergents comprising the same detergent type each having a different TBN. Preferably, the detergent will have, or have on average, a TBN of at least about 200 mg KOH/g, such as from about 200 to about 500 mg KOH/g; preferably from about 200 to about 450 mg KOH/g.

Optionally, the composition additionally comprises a further detergent. Preferably, the further detergent is substantially free of calcium. Optionally, the further detergent comprises one or more phenate, sulfonate and/or salicylate detergents. The further detergent may be an overbased or neutral detergent. Optionally, the further detergent comprises one or more neutral metal-containing detergents (having a TBN of less than 150). These neutral metal-based detergents may be magnesium salts or salts of other alkali or alkali earth metals, except calcium. Optionally, 100% of the metal introduced into the lubricating oil composition by detergent is calcium. The further detergent may also contain ashless (metal-free) detergents such as oil-soluble hydrocarbyl phenol aldehyde condensates described, for example, in US 2005/0277559 A1.

Preferably, overbased detergents based on metals other than calcium are present in amounts contributing no greater than 60%, such as no greater than 50% or no greater than 40% of the TBN of the lubricating oil composition contributed by overbased detergent.

In one embodiment, the detergent is substantially free from any detergent that is not a calcium detergent. In other words, it may be that the detergent consists of one or more calcium detergents. It will be appreciated that where a detergent is said to be substantially free from anything other than a particular type of detergent, or is said to consist of that particular type of detergent, the detergent may nevertheless comprise trace amounts of another material. For example, it may be that the detergent comprises a trace amount of another material left over from the preparation process used to make the detergent.

Suitably, at least 75%, for example at least 90%, such as at least 95%, or preferably 100% of the calcium content of the lubricating oil composition is provided by the detergent. It may be that when the calcium content of the lubricating composition is provided principally by the detergent, the detergent and LSPI characteristics of the composition can be controlled particularly effectively.

Preferably, detergent in total is used in an amount providing the lubricating oil composition with from 0.2 to 2.0 mass %, such as from 0.35 to 1.5 mass % or from 0.5 to 1.0 mass %, more preferably from about 0.6 to about 0.8 mass % of sulfated ash (SASH).

Additional additives may be incorporated into the compositions of the invention to enable particular performance requirements to be met. Examples of additional additives which may be included in the lubricating oil compositions of the present invention are metal rust inhibitors, viscosity index improvers, corrosion inhibitors, oxidation inhibitors, friction modifiers, antifoaming agents, anti-wear agents and pour point depressants. Some are discussed in further detail below.

The oil of lubricating viscosity useful in the formulation of lubricating oil compositions suitable for use in the practice of the invention may range in viscosity from light distillate mineral oils to heavy lubricating oils such as gasoline engine oils, mineral lubricating oils and heavy duty diesel engine oils. Generally, the viscosity of the oil ranges from about 2 $mm^2$/sec (centistokes) to about 40 $mm^2$/sec, especially from about 3 $mm^2$/sec to about 20 $mm^2$/sec, most preferably from about 9 $mm^2$/sec to about 17 $mm^2$/sec, measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivatives, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid. Also useful are synthetic oils derived from a gas to liquid process from Fischer-Tropsch synthesized hydrocarbons, which are commonly referred to as gas to liquid, or "GTL" base oils.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Other synthetic lubricating oils include liquid esters of phosphorous-containing acids (e.g., tricresyl phosphate, trioctyl phosphate, diethyl ester of decylphosphonic acid) and polymeric tetrahydrofurans.

The oil of lubricating viscosity may comprise a Group I, Group II, Group III, Group IV or Group V base stocks or base oil blends of the aforementioned base stocks. Preferably, the oil of lubricating viscosity is a Group II, Group III, Group IV or Group V base stock, or a mixture thereof, or a mixture of a Group I base stock and one or more a Group II, Group III, Group IV or Group V base stock. The base stock, or base stock blend preferably has a saturate content of at least 65%, more preferably at least 75%, such as at least 85%. Preferably, the base stock or base stock blend is a Group III or higher base stock or mixture thereof; or a mixture of a Group II base stock and a Group III or higher base stock or mixture thereof. Most preferably, the base stock, or base stock blend, has a saturate content of greater than 90%. Preferably, the oil or oil blend will have a sulfur content of less than 1 mass %, preferably less than 0.6 mass % most preferably less than 0.4 mass %, such as less than 0.3 mass %. In one preferred embodiment, at least 30 mass %, preferably at least 50 mass %, more preferably at least 80 mass %, of the oil of lubricating viscosity used in lubricating oil compositions of the present invention is Group III base stock, a Group IV base stock, or a mixture of Group II and Group IV base stocks.

Preferably the volatility of the oil or oil blend, as measured by the Noack test (ASTM D5800), is less than or equal to 30 mass %, such as less than about 25 mass %, preferably less than or equal to 20 mass %, more preferably less than or equal to 15 mass %, most preferably less than or equal 13 mass %. Preferably, the viscosity index (VI) of the oil or oil blend is at least 85, preferably at least 100, most preferably from about 105 to 140.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulfur and have a viscosity index greater than or equal to 80 and less than 120 using the test methods specified in Table 1;
b) Group II base stocks contain greater than or equal to 90 percent saturates and less than or equal to 0.03 percent sulfur and have a viscosity index greater than or equal to 80 and less than 120 using the test methods specified in Table 1;
c) Group III base stocks contain greater than or equal to 90 percent saturates and less than or equal to 0.03 percent sulfur and have a viscosity index greater than or equal to 120 using the test methods specified in Table 1;
d) Group IV base stocks are polyalphaolefins (PAO); and,
e) Group V base stocks include all other base stocks not included in Group I, II, III, or IV.

TABLE 1

Analytical Methods for Base Stock

| Property | Test Method |
|---|---|
| Saturates | ASTM D 2007 |
| Viscosity Index | ASTM D 2270 |
| Sulfur | ASTM D 2622; ASTM D 4294; ASTM D 4927; ASTM D 3120 |

The lubricating oil compositions of all aspects of the present invention may further comprise a phosphorus-containing compound.

A suitable phosphorus-containing compound includes dihydrocarbyl dithiophosphate metal salts, which are frequently used as anti-wear and antioxidant agents. The metal may be an alkali or alkaline earth metal, or aluminium, lead, tin, molybdenum, manganese, nickel or copper. Zinc salts of dihydrocarbyl dithiophosphate salts are most commonly used in lubricating oil in amounts of 0.1 to 10, preferably 0.2 to 2 mass %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil soluble salts of dihydrocarbyl dithiophosphoric acids and may be represented by the following formula:

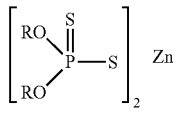

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate (ZDDP) can therefore comprise zinc dialkyl dithiophosphates.

Lubricating oil compositions of the present invention suitably have a phosphorous content of no greater than about 0.12 mass % (1200 ppm). Preferably, in the practice of the present invention, ZDDP is used in an amount that provides a phosphorus content of no greater than 0.10 mass % (1000 ppm), such as no greater than 0.08 mass % (800 ppm) to the lubricating oil composition. Preferably, in the practice of the present invention, ZDDP is used in an amount that provides a phosphorus content to the lubricating oil composition of at least 0.01 mass % (100 ppm), such as at least 0.04 mass % (400 ppm). In one embodiment of the present invention, ZDDP is used in an amount that provides the lubricating oil composition with at least 650 ppm phosphorus. Thus, lubricating oil compositions useful in the practice of the present invention will preferably contain ZDDP or other zinc-phosphorus compounds, in an amount introducing from 0.01 to 0.12 mass % of phosphorus, such as from 0.04 to 0.10 mass % of phosphorus, preferably, from 0.065 to 0.12 mass % or 0.65 to 0.10 mass % of phosphorus, based on the total mass of the lubricating oil composition.

Anti-oxidants are sometimes referred to as oxidation inhibitors; they increase the resistance of the composition to oxidation and may work by combining with and modifying peroxides to render them harmless, by decomposing peroxides, or by rendering an oxidation catalyst inert. Oxidative deterioration can be evidenced by sludge in the lubricant, varnish-like deposits on the metal surfaces, and by viscosity growth.

They may be classified as radical scavengers (e.g. sterically hindered phenols, aromatic amines, particularly secondary aromatic amines having at least two aromatic (e.g. phenyl groups) groups attached directly to the nitrogen atom, and organo-copper salts); hydroperoxide decomposers (e.g., organosulfur and organophosphorus additives); and multifunctionals (e.g. zinc dihydrocarbyl dithiophosphates, which may also function as anti-wear additives).

The lubricating oil composition in all aspects of the present invention may include an anti-oxidant, more preferably an ashless anti-oxidant. Suitably, the anti-oxidant, when present, is an ashless aromatic amine anti-oxidant, an ashless phenolic anti-oxidant or a combination thereof. The lubricating oil composition in all aspects of the present invention may include both an aromatic amine and phenolic anti-oxidant.

Suitably, the total amount of anti-oxidant (e.g. aromatic amine anti-oxidant, a phenolic anti-oxidant or a combination thereof) which may be present in the lubricating oil composition is greater than or equal to 0.05, preferably greater than or equal to 0.1, even more preferably greater than or equal to 0.2, mass % based on the total mass of the lubricating oil composition. Suitably, the total amount of anti-oxidant which may be present in the lubricating oil composition is less than or equal to 5.0, preferably less than or equal to 3.0, even more preferably less than or equal to 2.5, mass % based on the total mass of the lubricating oil composition Dispersants maintain in suspension materials resulting from oxidation during use that are insoluble in oil, thus preventing sludge flocculation and precipitation, or deposition on metal parts. The lubricating oil composition of the present invention comprises at least one dispersant, and may comprise a plurality of dispersants. The dispersant or dispersants are preferably nitrogen-containing dispersants and preferably contribute, in total, from 0.05 to 0.19 mass %, such as from 0.06 to 0.18 mass %, most preferably from 0.07 to 0.16 mass % of nitrogen to the lubricating oil composition.

Dispersants useful in the context of the present invention include the range of nitrogen-containing, ashless (metal-free) dispersants known to be effective to reduce formation of deposits upon use in gasoline and diesel engines, when added to lubricating oils and comprise an oil soluble polymeric long chain backbone having functional groups capable of associating with particles to be dispersed. Typically, such dispersants have amine, amine-alcohol or amide polar moieties attached to the polymer backbone, often via a bridging group. The ashless dispersant may be, for example, selected from oil soluble salts, esters, amino-esters, amides, imides and oxazolines of long chain hydrocarbon-substituted mono- and poly-carboxylic acids or anhydrides thereof; thiocarboxylate derivatives of long chain hydrocarbons; long chain aliphatic hydrocarbons having polyamine moieties attached directly thereto; and Mannich condensation products formed by condensing a long chain substituted phenol with formaldehyde and polyalkylene polyamine.

The polyalkenyl moiety of the dispersant of the present invention has a number average molecular weight of from 700 to 3000, preferably between 900 and 3000, such as between 950 and 2800, preferably from about 950 to 2500. The molecular weight of a dispersant is generally expressed in terms of the molecular weight of the polyalkenyl moiety as the precise molecular weight range of the dispersant depends on numerous parameters including the type of polymer used to derive the dispersant, the number of functional groups, and the type of nucleophilic group employed.

The polyalkenyl moiety from which the high molecular weight dispersants are derived preferably have a narrow molecular weight distribution (MWD), also referred to as polydispersity, as determined by the ratio of weight average molecular weight (Mw) to number average molecular weight (Mn). Specifically, polymers from which the dispersants of the present invention are derived have a Mw/Mn of from 1.5 to 2.0, preferably from 1.5 to 1.9, most preferably from 1.6 to 1.8.

Suitable hydrocarbons or polymers employed in the formation of the dispersants of the present invention include homopolymers, interpolymers or lower molecular weight hydrocarbons. One family of such polymers comprise polymers of ethylene and/or at least one $C_3$ to $C_{28}$ alpha-olefin having the formula $H_2C{=}CHR^1$ wherein $R^1$ is straight or branched chain alkyl radical comprising 1 to 26 carbon atoms and wherein the polymer contains carbon-to-carbon unsaturation, preferably a high degree of terminal ethenylidene unsaturation. Another useful class of polymers is polymers prepared by cationic polymerization of isobutene, styrene, and the like. Common polymers from this class include polyisobutenes obtained by polymerization of a $C_4$ refinery stream having a butene content of 35 to 75 mass %, and an isobutene content of 30 to 60 mass %, in the presence of a Lewis acid catalyst, such as aluminum trichloride or boron trifluoride.

Polyisobutylene polymers that may be employed are generally based on a hydrocarbon chain of from 700 to 3000. Methods for making polyisobutylene are known. Polyisobutylene can be functionalized by halogenation (e.g. chlorination), the thermal "ene" reaction, or by free radical grafting using a catalyst (e.g. peroxide), as described below.

The hydrocarbon or polymer backbone can be functionalized, e.g., with carboxylic acid producing moieties (preferably acid or anhydride moieties) selectively at sites of carbon-to-carbon unsaturation on the polymer or hydrocarbon chains, or randomly along chains using any of the three processes mentioned above or combinations thereof, in any sequence.

The functionalized oil-soluble polymeric hydrocarbon backbone is then derivatized with a nitrogen-containing nucleophilic reactant, such as an amine, aminoalcohol, amide, or mixture thereof, to form a corresponding derivative. Amine compounds are preferred. Preferred amines are aliphatic saturated amines, including for example, 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene)triamine. Such polyamine mixtures, known as PAM, are commercially available. Particularly preferred polyamine mixtures are mixtures derived by distilling the light ends from PAM products. The resulting mixtures, known as "heavy" PAM, or HPAM, are also commercially available. The properties and attributes of both PAM and/or HPAM are described, for example, in U.S. Pat. Nos. 4,938,881; 4,927,551; 5,230,714; 5,241,003; 5,565,128; 5,756,431; 5,792,730; and 5,854,186.

A preferred dispersant composition is one comprising at least one polyalkenyl succinimide, which is the reaction product of a polyalkenyl substituted succinic anhydride (e.g., PIBSA) and a polyamine (PAM) that has a coupling ratio of from 0.65 to 1.25, preferably from 0.8 to 1.1, most preferably from 0.9 to 1. In the context of this disclosure, "coupling ratio" may be defined as a ratio of the number of succinyl groups in the PIBSA to the number of primary amine groups in the polyamine reactant.

Another class of high molecular weight ashless dispersants comprises Mannich base condensation products.

The dispersant(s) of the present invention are preferably non-polymeric (e.g., are mono- or bis-succinimides).

The dispersant(s) of the present invention, particularly the lower molecular weight dispersants, may optionally be borated. Such dispersants can be borated by conventional means, as generally taught in U.S. Pat. Nos. 3,087,936, 3,254,025 and 5,430,105. In an embodiment of the present invention, a borated dispersant is the only source of any boron that is present in a lubricating oil composition.

Dispersants derived from highly reactive polyisobutylene have been found to provide lubricating oil compositions with a wear credit relative to a corresponding dispersant derived from conventional polyisobutylene. This wear credit is of particular importance in lubricants containing reduced levels of ash-containing anti-wear agents, such as ZDDP. Thus, in one preferred embodiment, at least one dispersant used in the lubricating oil compositions of the present invention is derived from highly reactive polyisobutylene.

Friction modifiers and fuel economy agents that are compatible with the other ingredients of the final oil may also be included. Examples of such materials include glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine.

The viscosity index of the base stock is increased, or improved, by incorporating therein certain polymeric materials that function as viscosity modifiers (VM) or viscosity index improvers (VII). Generally, polymeric materials useful as viscosity modifiers are those having number average molecular weights (Mn) of from about 5,000 to about 250,000, preferably from about 15,000 to about 200,000, more preferably from about 20,000 to about 150,000. These viscosity modifiers can be grafted with grafting materials such as, for example, maleic anhydride, and the grafted material can be reacted with, for example, amines, amides, nitrogen-containing heterocyclic compounds or alcohol, to form multifunctional viscosity modifiers (dispersant-viscosity modifiers). Polymer molecular weight, specifically Mn, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method for determining molecular weight, particularly for lower molecular weight polymers, is vapor pressure osmometry (see, e.g., ASTM D3592).

In one preferred embodiment, at least one viscosity modifier used in the lubricating oil compositions of the present invention is a linear diblock copolymer comprising one block derived primarily, preferably predominantly, from vinyl aromatic hydrocarbon monomer, and one block derived primarily, preferably predominantly, from diene monomer. Useful vinyl aromatic hydrocarbon monomers include those containing from 8 to about 16 carbon atoms such as aryl-substituted styrenes, alkoxy-substituted styrenes, vinyl naphthalene, alkyl-substituted vinyl naphthalenes and the like. Dienes, or diolefins, contain two double bonds, commonly located in conjugation in a 1,3 relationship. Olefins containing more than two double bonds, sometimes referred to as polyenes, are also considered within the definition of "diene" as used herein. Useful dienes include those containing from 4 to about 12 carbon atoms, preferably from 8 to about 16 carbon atoms, such as 1,3-butadiene, isoprene, piperylene, methylpentadiene, phenylbutadiene, 3,4-dimethyl-1,3-hexadiene, 4,5-diethyl-1,3-octadiene, with 1,3-butadiene and isoprene being preferred.

As used herein in connection with polymer block composition, "predominantly" means that the specified monomer or monomer type that is the principle component in that polymer block is present in an amount of at least 85% by weight of the block.

Polymers prepared with diolefins will contain ethylenic unsaturation, and such polymers are preferably hydrogenated. When the polymer is hydrogenated, the hydrogenation may be accomplished using any of the techniques known in the prior art. For example, the hydrogenation may be accomplished such that both ethylenic and aromatic unsaturation is converted (saturated) using methods such as those taught, for example, in U.S. Pat. Nos. 3,113,986 and 3,700,633 or the hydrogenation may be accomplished selectively such that a significant portion of the ethylenic unsaturation is converted while little or no aromatic unsaturation is converted as taught, for example, in U.S. Pat. Nos. 3,634,595; 3,670,054; 3,700,633 and U.S. Re 27,145. Any of these methods can also be used to hydrogenate polymers containing only ethylenic unsaturation and which are free of aromatic unsaturation.

The block copolymers may include mixtures of linear diblock polymers as disclosed above, having different molecular weights and/or different vinyl aromatic contents as well as mixtures of linear block copolymers having different molecular weights and/or different vinyl aromatic contents. The use of two or more different polymers may be preferred to a single polymer depending on the theological properties the product is intended to impart when used to produce formulated engine oil. Examples of commercially available styrene/hydrogenated isoprene linear diblock copolymers include Infineum SV140™, Infineum SV150™ and Infineum SV160™, available from Infineum USA L.P. and Infineum UK Ltd.; Lubrizol® 7318, available from The Lubrizol Corporation; and Septon 1001™ and Septon 1020™, available from Septon Company of America (Kuraray Group). Suitable styrene/1,3-butadiene hydrogenated block copolymers are sold under the tradename Glissoviscal™ by BASF.

Pour point depressants (PPD), otherwise known as lube oil flow improvers (LOFIs) lower the temperature. Compared to VM, LOFIs generally have a lower number average molecular weight. Like VM, LOFIs can be grafted with grafting materials such as, for example, maleic anhydride, and the grafted material can be reacted with, for example, amines, amides, nitrogen-containing heterocyclic compounds or alcohol, to form multifunctional additives.

In the present invention, it may be necessary to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed. In another preferred embodiment, the lubricating oil compositions of the present invention contain an effective amount of a long chain hydrocarbons functionalized by reaction with mono- or dicarboxylic acids or anhydrides.

When lubricating compositions contain one or more of the above-mentioned additives, each additive is typically blended into the base oil in an amount that enables the additive to provide its desired function. Representative effective amounts of such additives, when used in crankcase lubricants, are listed below. All the values listed (with the exception of detergent values) are stated as mass percent active ingredient (A.I.). As used herein, A.I. refers to additive material that is not diluent or solvent.

| ADDITIVE | MASS % (Broad) | MASS % (Preferred) |
|---|---|---|
| Dispersant | 0.1-20 | 1-10 |
| Metal Detergents | 0.1-15 | 0.2-9 |
| Corrosion Inhibitor | 0-5 | 0-1.5 |
| Metal Dihydrocarbyl Dithiophosphate | 0.1-6 | 0.1-4 |
| Antioxidant | 0-5 | 0.01-3.5 |
| Pour Point Depressant | 0.01-5 | 0.01-1.5 |
| Supplemental Antiwear Agents | 0-1.0 | 0-0.5 |
| Friction Modifier | 0-5 | 0-1.5 |
| Viscosity Modifier | 0.01-10 | 0.25-3 |
| Base stock | Balance | Balance |

Lubricating oil compositions useful in the practice of the present invention may have an overall sulfated ash content of from 0.3 to 1.2 mass %, such as from 0.4 to 1.1 mass e, preferably from 0.5 to 1.0 mass %.

It may be desirable, although not essential to prepare one or more additive concentrates comprising additives (concentrates sometimes being referred to as additive packages) whereby several additives can be added simultaneously to the oil to form the lubricating oil composition.

The final composition may employ from 5 to 25 mass %, preferably 5 to 22 mass %, typically 10 to 20 mass % of the concentrate, the remainder being oil of lubricating viscosity.

Preferably, the engine of the method of the second aspect of the invention, and/or the use of the third aspect of the invention, is an engine that generates a brake mean effective pressure level of greater than 1,500 kPa, optionally greater than 2,000 kPa, at engine speeds of from 1,000 to 2,500 rotations per minute (rpm), optionally from 1,000 to 2,000 rpm.

Preferably, the lubricating oil composition in the method of the second aspect of the invention, and/or the use of the third aspect of the invention, has a silicon content of at least 12 ppm by weight, based on the weight of the lubricating oil composition. Optionally, the lubricating oil composition has a calcium content of at least 0.08 wt %, based on the weight of the lubricating oil composition.

This invention will be further understood by reference to the following examples, wherein all parts are parts by mass, unless otherwise noted and which include preferred embodiments of the invention.

DESCRIPTION OF THE EXAMPLES

Whilst the present invention has been described and illustrated with reference to particular embodiments, it will be appreciated by those of ordinary skill in the art that the invention lends itself to many different variations not specifically illustrated herein. By way of example only, certain possible variations will now be described.

In the following Examples, data regarding LSPI occurrences was generated using a turbocharged, direct injected, GM Ecotec 2.0 liter, 4 cylinder engine, the boost level of which was modified to generate a brake mean effective pressure level of about 2,300 kPa (23 bar), at an engine speed of about 2000 rpm. For each cycle (a cycle being 2 piston cycles (up/down, up/down)), data was collected at 0.5° crank angle resolution. Post processing of the data included calculation of combustion metrics, verification of operating parameters being within target limits, and detection of LSPI events (statistical procedure outlined below). From the above data, outliers, which are potential occurrences of LSPI were collected. For each LSPI cycle, data recorded included peak pressure (PP), MFB02 (crank angle at 2% mass fraction burned), as well as other mass fractions (10%, 50% and 90%), cycle number and engine cylinder. A cycle was identified as having an LSPI event if either or both of the crank angle corresponding to MFB02 of the fuel and the cylinder PP are outliers. Outliers were determined relative to the distribution of a particular cylinder and test segment in which it occurs. Determination of "outliers" was an iterative process involving calculation of the mean and standard deviation of PP and MFB02 for each segment and cylinder; and cycles with parameters that exceed n standard deviations from the mean. The number of standard deviations n, used as a limit for determining outliers, is a function of the number of cycles in the test and was calculated using the Grubbs' test for outliers. Outliers were identified in the severe tail of each distribution. That is, if n is the number of standard deviations obtained from Grubbs' test for outliers, an outlier for PP is identified as one exceeding the mean plus n standard deviations of peak pressure. Likewise, an outlier for MFB02 was identified as one being lower than the mean less n standard deviations of MFB02. Data was further examined to ensure that the outliers indicated an occurrence of LSPI, rather than some other abnormal combustion event of an electrical sensor error.

An LSPI "event" was taken as one in which there were three "normal" cycles both before and after. An LSPI event may include more than one LSPI cycle or outlier. While this method was used here, it is not part of the present invention. Studies conducted by others have counted each individual cycle, whether or not it is part of a multiple cycle event. The present definition of an LSPI event is shown in FIG. 1 wherein 1 represents a single LSPI event comprising multiple LSPI cycles. This is considered to be a single LSPI event because each single cycle was not preceded and followed by three normal events; 2 represents more than three normal events, and 3 represents a second LSPI event comprising only a single LSPI cycle. The LSPI trigger level, represented by 4, is determined by the engine used and relates to the normal function for that engine.

A series of 5W-30 grade lubricating oil compositions representing typical passenger car motor oils meeting the GF-4 specification were prepared. The formulation of these compositions is shown in Table 2 below.

TABLE 2

| Comparative Example and Example Formulations | | | | | | | |
|---|---|---|---|---|---|---|---|
| Constituent Type | Comparative Example 1 Qty (wt %) | Example 1 Qty (wt %) | Comparative Example 2 Qty (wt %) | Example 2 Qty (wt %) | Example 3 Qty (wt %) | Example 4 Qty (wt %) | Example 5 Qty (wt %) |
| Calcium Salicylate (220 TBN) | 2.14 | 2.14 | 2.14 | 2.14 | 2.14 | 2.14 | 2.14 |
| Calcium Salicylate (64 TBN) | 0.55 | 0.55 | 0.55 | 0.55 | 0.55 | 0.55 | 0.55 |

TABLE 2-continued

| Comparative Example and Example Formulations | | | | | | | |
|---|---|---|---|---|---|---|---|
| Constituent Type | Comparative Example 1 Qty (wt %) | Example 1 Qty (wt %) | Comparative Example 2 Qty (wt %) | Example 2 Qty (wt %) | Example 3 Qty (wt %) | Example 4 Qty (wt %) | Example 5 Qty (wt %) |
| Additive package | 7.83 | 7.83 | 7.83 | 7.83 | 7.83 | 7.83 | 7.83 |
| Standard Si Antifoam | 0.004 | 0.018 | | | | | |
| MFP P40 | | | 0.2 | | | | |
| $Si(OEt)_4$ | | | | 0.074 | | | |
| $Si(C_2H_5)_4$ | | | | | 0.051 | | |
| $Si(OC_4H_9)_4$ | | | | | | 0.114 | |
| $C_8H_{28}N_4Si_4$ | | | | | | | 0.026 |
| PPD | 0.2 | 0.2 | 0.2 | 0.2 | 0.2 | 0.2 | 0.2 |
| VM | 5.6 | 5.6 | 5.6 | 5.6 | 5.6 | 5.6 | 5.6 |
| Base oil | Balance | Balance | Balance | Balance | Balance | Balance | Balance |

The additive package was the same for each formulation and contained a borated polyisobutylenesuccinimide-polyamine dispersant, a non-borated polyisobutylenesuccinimide-polyamine, a zinc dialkyldithiocarbamate, diphenylamine antioxidant and polyisobutylene succinic anhydride in a diluent oil. The formulations additionally comprised the same combination of pour point depressant, viscosity modifier and base oil.

The Standard Si Antifoam was a polydimethylsiloxane. The MFP P40 is a non-Si antifoam from MODAREZ®, which is an acrylate antifoam additive. The tetraethyl orthosilicate ($Si(OEt)_4$), tetraethylsilane ($Si(C_2H_5)_4$) and tetrabutylorthosilicate ($Si(OC_4H_9)_4$) are non-antifoam silicon additives. The octamethylcyclotetrasilazane ($C_8H_{28}N_4Si_4$) is a silazane ring compound.

| Selected elemental analysis results of the comparative example and example | | | | | | | |
|---|---|---|---|---|---|---|---|
| Constituent | Comparative Example 1 | Example 1 | Comparative Example 2 | Example 2 | Example 3 | Example 4 | Example 5 |
| Ash % | 0.78 | 0.78 | 0.78 | 0.78 | 0.78 | 0.78 | 0.78 |
| B ppm | 70 | 70 | 70 | 70 | 70 | 70 | 70 |
| Ca % | 0.184 | 0.184 | 0.184 | 0.184 | 0.184 | 0.184 | 0.184 |
| Mg % | 0 | 0 | 0 | 0 | 0 | 0 | 0 |
| N % | 0.097 | 0.097 | 0.097 | 0.097 | 0.097 | 0.097 | 0.097 |
| P % | 0.08 | 0.08 | 0.08 | 0.08 | 0.08 | 0.08 | 0.08 |
| S % | 0.19 | 0.19 | 0.19 | 0.19 | 0.19 | 0.19 | 0.19 |
| Si ppm | 4 | 21 | 1 | 86 | 110 | 87 | 93 |

compositions are shown in Table 3 below.

Table 3—Contents of Comparative Example and Example Compositions

In Comparative Example 1, the formulation includes a typical dose of a silicon antifoam, the oil composition having a silicon content of 4 ppm. In Example 1, the dosage of the silicon antifoam used in Comparative Example 1 is increased to provide a silicon content of 21 ppm in the oil composition. In Comparative Example 2, the oil composition comprises a large amount of a non-silicon antifoam additive, thus providing a composition with a low silicon content of 1 ppm. In Examples 2-5, the silicon content of the oil composition is provided using a non-antifoam silicon additive, each providing a composition having a significantly higher silicon content than conventional.

The formulations were tested for LSPI event occurrence as described above, the results being presented in Table 4.

TABLE 4

| LSPI Test Results with Comparative Example and Example Formulations. | |
|---|---|
| Formulation | Avg. LSPI Per Test |
| Example 1 | 29 |
| Comparative Example 2 | 68 |
| Example 2 | 26 |
| Example 3 | 15 |
| Example 4 | 12 |
| Example 5 | 17 |

A comparison of Example 1 and Comparative Example 1 shows that increasing the silicon content by adding additional silicon antifoam effects a significant a reduction in LSPI event frequency. This indicates that an increase in the amount of silicon antifoam additive above the conventional minor amount provides an unexpected reduction in LSPI event frequency.

The results of Comparative Example 2 shows that larger amounts of a non-silicon antifoam are not effective at reducing LSPI event frequency. In other words, the present inventors believe that it is the increased silicon content in the formulation of Example 1, and not the increased antifoam functionality, that provides the LSPI event frequency reduction, compared to the formulation of Comparative Example 1.

Examples 2, 3, 4 and 5 illustrate the effectiveness of higher amounts of silicon provided by different non-antifoam silicon compounds in reducing LSPI event frequency.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

What is claimed is:

1. A lubricating oil composition comprising a base oil of lubricating viscosity, one or more calcium containing detergents, and one or more silicone containing compounds, wherein:

i) the one or more calcium containing detergents comprise a combination of a calcium salicylate detergent having a TBN of at least 64 mg KOH/g and a calcium salicylate detergent having a TBN of at least 220 mg KOH/g and the combination provides the lubricating oil composition with a calcium content of 0.184 wt. %, based on the weight of the lubricating oil composition, ii) the one or more silicone containing compounds provide the lubricating oil composition with a silicon content of about 20 to about 110 ppm by weight, based on the weight of the lubricating oil composition and are selected from the group consisting of polydimethylsiloxane, tetraethyl orthosilicate ($Si(OEt)_4$), tetraethylsilane ($Si(C_2H_5)_4$), tetrabutylorthosilicate ($Si(OC_4H_9)_4$) and octamethylcyclotetrasilazane ($C_8H_{28}N_4Si_4$), and iii) when the lubricating oil composition is used to lubricate the crankcase of a direct injection-spark ignition internal combustion engine, the frequency of low-speed pre-ignition events is reduced as compared to the lubricating oil composition having less than or equal to 12 ppm by weight silicon content.

2. The lubricating oil composition of claim 1, wherein when the lubricating oil composition is used to lubricate the crankcase of a direct injection-spark ignition internal combustion engine, the frequency of low-speed pre-ignition events is reduced as compared to the lubricating oil composition having less than or equal to 4 ppm by weight silicon content.

3. The lubricating oil composition of claim 1, wherein when the lubricating oil composition is used to lubricate the crankcase of a direct injection-spark ignition internal combustion engine, the frequency of low-speed pre-ignition events is on average less than or equal to 29 event occurrences per test.

4. The lubricating oil composition of claim 1, wherein the calcium salicylate detergent having a TBN of at least 220 mg KOH/g has a TBN of about 220 mg KOH/g and the calcium salicylate detergent having a TBN of at least 64 mg KOH/g has a TBN of about 64 mg KOH/g.

5. The lubricating oil composition of claim 4, wherein the calcium salicylate detergent having a TBN of about 220 mg KOH/g is incorporated into the composition at about 2.14 wt. %, based on the weight of the lubricating oil composition, and the calcium salicylate detergent having a TBN of about 64 mg KOH/g is incorporated into the composition at about 0.55 wt. %, based on the weight of the lubricating oil composition.

6. The lubricating oil composition of claim 1, wherein the one or more calcium containing detergents provide the lubricating oil composition with a calcium content of about 0.184 wt. %, based on the weight of the lubricating oil composition.

7. The lubricating oil composition of claim 1, wherein the one or more silicone containing compounds comprises polydimethylsiloxane at a treat level to provide a silicon content of about 21 ppm by weight, based on the weight of the lubricating oil composition.

8. The lubricating oil composition of claim 1, wherein the one or more silicone containing compounds comprises tetraethyl orthosilicate ($Si(OEt)_4$) at a treat level to provide a silicon content of about 86 ppm by weight, based on the weight of the lubricating oil composition.

9. The lubricating oil composition of claim 1, wherein the one or more silicone containing compounds comprises tetraethylsilane ($Si(C_2H_5)_4$) at a treat level to provide a silicon content of about 110 ppm by weight, based on the weight of the lubricating oil composition.

10. The lubricating oil composition of claim 1, wherein the one or more silicone containing compounds comprises tetrabutylorthosilicate ($Si(OC_4H_9)_4$) at a treat level to provide a silicon content of about 87 ppm by weight, based on the weight of the lubricating oil composition.

11. The lubricating oil composition of claim 1, wherein the one or more silicone containing compounds comprises octamethylcyclotetrasilazane ($C_8H_{28}N_4Si_4$) at a treat level to provide a silicon content of about 93 ppm by weight, based on the weight of the lubricating oil composition.

12. The lubricating oil composition of claim 1, wherein the lubricating oil composition further comprises a neutral metal-based detergent that is substantially free of calcium.

13. The lubricating oil composition of claim 12, wherein the neutral metal-based detergent is a magnesium salt.

14. The lubricating oil composition of claim 1, wherein, in operation, the direct injection-spark ignition internal combustion engine generates a brake mean effective pressure level of greater than 1,500 kPa, at engine speeds of from 1,000 to 2,500 rotations per minute (rpm).

15. The lubricating oil composition of claim 1, wherein the engine is a turbocharged or supercharged internal combustion engine.

16. A method of reducing low-speed pre-ignition (LSPI) events in a direct-injection spark-ignition internal combustion engine comprising lubricating the crankcase of the engine with a lubricating oil composition comprising: a base oil of lubricating viscosity, one or more calcium containing detergents, and one or more silicone containing compounds, wherein:

i) the one or more calcium containing detergents comprise a combination of a calcium salicylate detergent having a TBN of at least 64 mg KOH/g and a calcium salicylate detergent having a TBN of at least 220 mg KOH/g and the combination provides the lubricating oil composition with a calcium content of 0.184 wt. %, based on the weight of the lubricating oil composition, ii) the one or more silicone containing compounds provide the lubricating oil composition with a silicon content of about 20 to about 110 ppm by weight, based on the weight of the lubricating oil composition and are selected from the group consisting of polydimethylsiloxane, tetraethyl orthosilicate ($Si(OEt)_4$), tetraethylsilane ($Si(C_2H_5)_4$), tetrabutylorthosilicate ($Si(OC_4H_9)_4$) and octamethylcyclotetrasilazane ($C_8H_{28}N_4Si_4$), and iii) when the lubricating oil composition is used to lubricate the crankcase of a direct injection-spark ignition internal combustion engine, the frequency of low-speed pre-ignition events is reduced as compared to the lubricating oil composition having less than or equal to 12 ppm by weight silicon content.

17. The method of claim 16, wherein when the lubricating oil composition is used to lubricate the crankcase of a direct injection-spark ignition internal combustion engine, the frequency of low-speed pre-ignition events is reduced as compared to the lubricating oil composition having less than or equal to 4 ppm by weight silicone content.

18. The method of claim 16, wherein when the lubricating oil composition is used to lubricate the crankcase of a direct injection-spark ignition internal combustion engine, the frequency of low-speed pre-ignition events is on average less than or equal to 29 event occurrences per test.

19. The method of claim 16, wherein the calcium salicylate detergent having a TBN of at least 220 mg KOH/g has a TBN of about 220 mg KOH/g and the calcium salicylate detergent having a TBN of at least 64 mg KOH/g has a TBN of about 64 mg KOH/g.

20. The method of claim 19, wherein the calcium salicylate detergent having a TBN of about 220 mg KOH/g is incorporated into the composition at about 2.14 wt. %, based on the weight of the lubricating oil composition, and the calcium salicylate detergent having a TBN of about 64 mg KOH/g is incorporated into the composition at about 0.55 wt. %, based on the weight of the lubricating oil composition.

21. The method of claim 16, wherein the one or more calcium containing detergents provide the lubricating oil composition with a calcium content of about 0.184 wt. %, based on the weight of the lubricating oil composition.

22. The method of claim 16, wherein the one or more silicone containing compounds comprises polydimethylsiloxane at a treat level to provide a silicon content of about 21 ppm by weight, based on the weight of the lubricating oil composition.

23. The method of claim 16, wherein the one or more silicone containing compounds comprises tetraethyl orthosilicate ($Si(OEt)_4$) at a treat level to provide a silicon content of about 86 ppm by weight, based on the weight of the lubricating oil composition.

24. The method of claim 16, wherein the one or more silicone containing compounds comprises tetraethylsilane ($Si(C_2H_5)_4$) at a treat level to provide a silicon content of about 110 ppm by weight, based on the weight of the lubricating oil composition.

25. The method of claim 16, wherein the one or more silicone containing compounds comprises tetrabutylorthosilicate ($Si(OC_4H_9)_4$) at a treat level to provide a silicon content of about ppm by weight, based on the weight of the lubricating oil composition.

26. The method of claim 16, wherein the one or more silicone containing compounds comprises octamethylcyclotetrasilazane ($C_8H_{28}N_4Si_4$) at a treat level to provide a silicon content of about 93 ppm by weight, based on the weight of the lubricating oil composition.

27. The method of claim 16, wherein the lubricating oil composition further comprises a neutral metal-based detergent that is substantially free of calcium.

28. The method of claim 27, wherein the neutral metal-based detergent is a magnesium salt.

29. The method of claim 16, wherein, in operation, the direct injection-spark ignition internal combustion engine generates a brake mean effective pressure level of greater than 1,500 kPa, at engine speeds of from 1,000 to 2,500 rotations per minute (rpm).

30. The method of claim 16, wherein the engine is a turbocharged or supercharged internal combustion engine.

31. A lubricating oil composition comprising a base oil of lubricating viscosity, one or more calcium containing detergents, and one or more silicone containing compounds, wherein:

i) the one or more calcium containing detergents provides the lubricating oil composition with a calcium content of 0.184 wt. %, based on the weight of the lubricating oil composition, ii) the one or more silicone containing compounds provide the lubricating oil composition with a silicon content of about 20 to about 110 ppm by weight, based on the weight of the lubricating oil composition and are selected from the group consisting of polydimethylsiloxane, tetraethyl orthosilicate ($Si(OEt)_4$), tetraethylsilane ($Si(C_2H_5)_4$), tetrabutylorthosilicate ($Si(OC_4H_9)_4$) and octamethylcyclotetrasilazane ($C_8H_{28}N_4Si_4$), and iii) when the lubricating oil composition is used to lubricate the crankcase of a direct injection-spark ignition internal combustion engine, the frequency of low-speed pre-ignition events is reduced as compared to the lubricating oil composition having less than or equal to 12 ppm by weight silicon content.

32. The lubricating oil composition of claim 31, wherein when the lubricating oil composition is used to lubricate the crankcase of a direct injection-spark ignition internal combustion engine, the frequency of low-speed pre-ignition events is reduced as compared to the lubricating oil composition having less than or equal to 4 ppm by weight silicon content.

33. The lubricating oil composition of claim 31, wherein when the lubricating oil composition is used to lubricate the crankcase of a direct injection-spark ignition internal combustion engine, the frequency of low-speed pre-ignition events is on average less than or equal to 29 event occurrences per test.

34. The lubricating oil composition of claim 31, wherein the one or more calcium containing detergents are selected from the group consisting of calcium salicylate, calcium sulfonate, calcium phenate and combinations thereof.

35. The lubricating oil composition of claim 31, wherein the one or more calcium containing detergents are overbased having a TBN ranging from 64 mg KOH/g to 450 mg KOH/g.

36. The lubricating oil composition of claim 31, wherein the one or more calcium containing detergents provide the lubricating oil composition with a calcium content of about 0.184 wt. %, based on the weight of the lubricating oil composition.

37. The lubricating oil composition of claim 31, wherein the one or more silicone containing compounds comprises polydimethylsiloxane at a treat level to provide a silicon content of about 21 ppm by weight, based on the weight of the lubricating oil composition.

38. The lubricating oil composition of claim 31, wherein the one or more silicone containing compounds comprises tetraethyl orthosilicate ($Si(OEt)_4$) at a treat level to provide a silicon content of about 86 ppm by weight, based on the weight of the lubricating oil composition.

39. The lubricating oil composition of claim 31, wherein the one or more silicone containing compounds comprises tetraethylsilane ($Si(C_2H_5)_4$) at a treat level to provide a silicon content of about 110 ppm by weight, based on the weight of the lubricating oil composition.

40. The lubricating oil composition of claim 31, wherein the one or more silicone containing compounds comprises tetrabutylorthosilicate ($Si(OC_4H_9)_4$) at a treat level to provide a silicon content of about 87 ppm by weight, based on the weight of the lubricating oil composition.

41. The lubricating oil composition of claim 31, wherein the one or more silicone containing compounds comprises octamethylcyclotetrasilazane ($C_8H_{28}N_4Si_4$) at a treat level to provide a silicon content of about 93 ppm by weight, based on the weight of the lubricating oil composition.

42. The lubricating oil composition of claim 31, wherein the lubricating oil composition further comprises a neutral metal-based detergent that is substantially free of calcium.

43. The lubricating oil composition of claim 42, wherein the neutral metal-based detergent is a magnesium salt.

44. The lubricating oil composition of claim 31, wherein, in operation, the direct injection-spark ignition internal combustion engine generates a brake mean effective pressure level of greater than 1,500 kPa, at engine speeds of from 1,000 to 2,500 rotations per minute (rpm).

45. The lubricating oil composition of claim 31, wherein the engine is a turbocharged or supercharged internal combustion engine.

* * * * *